US010030326B2

(12) United States Patent
Hines, Jr. et al.

(10) Patent No.: US 10,030,326 B2
(45) Date of Patent: Jul. 24, 2018

(54) LIGHTWEIGHT, DUAL HAZARD FABRICS

(71) Applicant: DRIFIRE, LLC, Columbus, GA (US)

(72) Inventors: Robert Winfred Hines, Jr., Columbus, GA (US); James Jonathan Bailey, Forston, GA (US)

(73) Assignee: DRIFIRE, LLC, Columbus, GA (US)

( * ) Notice: Subject to any disclaimer, the term of this patent is extended or adjusted under 35 U.S.C. 154(b) by 0 days.

(21) Appl. No.: 15/321,426

(22) PCT Filed: Jun. 15, 2015

(86) PCT No.: PCT/US2015/035783
§ 371 (c)(1),
(2) Date: Dec. 22, 2016

(87) PCT Pub. No.: WO2016/010659
PCT Pub. Date: Jan. 21, 2016

(65) Prior Publication Data

US 2017/0198423 A1 Jul. 13, 2017

Related U.S. Application Data

(60) Provisional application No. 62/024,619, filed on Jul. 15, 2014.

(51) Int. Cl.

| | |
|---|---|
| ***D03D 15/12*** | (2006.01) |
| ***D03D 15/00*** | (2006.01) |
| ***D03D 13/00*** | (2006.01) |
| ***D02G 3/04*** | (2006.01) |

(52) U.S. Cl.
CPC ..... *D03D 15/12* (2013.01); *D02G 3/047* (2013.01); *D03D 13/008* (2013.01); *D03D 15/0005* (2013.01); *D10B 2331/021* (2013.01)

(58) Field of Classification Search
CPC ..... D03D 15/12; D03D 15/00; D03D 1/0035; A41D 31/0022; A41D 1/02; A41D 1/06; A41D 13/1281; A62B 17/003
See application file for complete search history.

(56) References Cited

U.S. PATENT DOCUMENTS

| | | | | |
|---|---|---|---|---|
| 3,193,602 | A | 7/1965 | Leonard et al. | |
| 3,748,302 | A | 7/1973 | Jones | |
| 3,803,453 | A | 4/1974 | Hull | |
| 4,035,441 | A | 7/1977 | Endo et al. | |
| 4,107,129 | A | 8/1978 | Tanaka et al. | |
| 4,988,746 | A | 1/1991 | Tanaka et al. | |
| 5,275,627 | A | 1/1994 | Cates et al. | |
| 5,356,700 | A | 10/1994 | Tanaka et al. | |
| 7,156,883 | B2 * | 1/2007 | Lovasic | D02G 3/047 428/364 |
| 8,069,643 | B2 * | 12/2011 | Zhu | D02G 3/443 57/255 |
| 8,209,785 | B2 | 7/2012 | Underwood et al. | |
| 8,732,863 | B2 * | 5/2014 | Hines | D02G 3/047 2/69 |
| 8,973,164 | B2 * | 3/2015 | Hines | D02G 3/047 2/69 |
| 9,034,777 | B2 * | 5/2015 | Hines | D03D 15/00 442/136 |
| 9,745,674 | B2 * | 8/2017 | Hines | D02G 3/443 |
| 2005/0032449 | A1 * | 2/2005 | Lovasic | D02G 3/047 442/209 |
| 2005/0287364 | A1 * | 12/2005 | Zhu | D02G 3/047 428/357 |
| 2008/0152888 | A1 | 6/2008 | Tutterow et al. | |
| 2010/0009186 | A1 * | 1/2010 | Zhu | D02G 3/047 428/395 |
| 2010/0299817 | A1 * | 12/2010 | Zhu | D02G 3/443 2/458 |
| 2011/0191949 | A1 | 8/2011 | Underwood et al. | |
| 2011/0250810 | A1 * | 10/2011 | Zhu | D02G 3/047 442/199 |
| 2012/0146784 | A1 * | 6/2012 | Hines | A41D 13/1281 340/539.11 |

(Continued)

FOREIGN PATENT DOCUMENTS

| | | |
|---|---|---|
| AU | 2015224518 | 6/2015 |
| AU | 2013293487 | 6/2016 |

(Continued)

OTHER PUBLICATIONS

Third Office Action issued by the State Intellectual Property Office of People's Republic of China dated Jan. 23, 2017 for application 201380044738.1, filed on Jun. 28, 2013 and published as CN 104736750A on Jun. 24, 2015 (Applicant—Drifire, LLC // Inventor—Hines, et al.) (Original—4 pages // Translation—6 pages).

Notification of Reasons for Refusal dated Feb. 28, 2017 by the Japan Patent Office for JP Application 20150524289 filed on Jun. 28, 2013 and published as JP2015524517 on Aug. 24, 2015 (Applicant—Drifire, LLC // Inventor—Hines, et al.) (Original—3 pages // Translation—3 pages).

Final Rejection dated Feb. 10, 2017 by the U.S. Patent and Trademark Office for U.S. Appl. No. 14/417,726, filed Jan. 27, 2015 and published as US 2015-0191856 A1 on Jul. 9, 2015 (Applicant—Drifire, LLC // Inventor—Hines, et al.) (15 pages).

Karvin Product Catalog and Preliminary Technical Information (1982) (11 pages).

McIntyre, "Aramid fibers", 44 Rev. Prog. Coloration, vol. 25, (1995) (7 pages).

(Continued)

*Primary Examiner* — Bobby Muromoto, Jr.
(74) *Attorney, Agent, or Firm* — Ballard Spahr LLP

(57) ABSTRACT

Lightweight fabrics with a balance of high thermal properties, especially arc resistance and flash fire resistance, on the one hand, and durability and comfort properties, on the other hand, are disclosed. Articles, such as garments and linen, made from the lightweight fabrics are also disclosed. Spun yarns made with an intimate blend of fibers including flame resistant fiber, fire-resistant hydrophilic fibers, and a low level of anti-static fibers are described. The lightweight fabrics are particularly useful in garments for utility workers, industrial workers, military personnel, and firefighters.

20 Claims, No Drawings

(56) References Cited

U.S. PATENT DOCUMENTS

| | | | | |
|---|---|---|---|---|
| 2013/0042385 | A1* | 2/2013 | Hines | D02G 3/047 2/85 |
| 2013/0216810 | A1* | 8/2013 | Hines | D03D 15/00 428/219 |
| 2013/0254980 | A1 | 10/2013 | Underwood et al. | |
| 2014/0187113 | A1* | 7/2014 | Hines, Jr. | D03D 1/0035 442/199 |
| 2014/0223650 | A1* | 8/2014 | Hines | D02G 3/047 2/458 |
| 2015/0191856 | A1* | 7/2015 | Hines | D02G 3/443 428/221 |
| 2016/0060809 | A1* | 3/2016 | Hines | D06P 3/8204 428/219 |

FOREIGN PATENT DOCUMENTS

| | | | |
|---|---|---|---|
| CA | 2879861 | | 6/2013 |
| CN | 201380044738.1 | | 6/2013 |
| EP | 0875620 | A1 | 11/1998 |
| EP | 13822850.7 | | 6/2013 |
| HK | 15109855.8 | | 6/2013 |
| IN | 929/CHENP/2015 | | 6/2013 |
| IN | 2937/DELN/2014 | | 10/2014 |
| JP | 2015-524289 | | 6/2013 |
| WO | WO-2008/027454 | A1 | 3/2008 |
| WO | WO-2011/008486 | A2 | 1/2011 |
| WO | WO-2011/126999 | A1 | 10/2011 |
| WO | WO-2011/137213 | A2 | 11/2011 |
| WO | WO-2012/016124 | A2 | 2/2012 |
| WO | WO-2012/068600 | A1 | 5/2012 |
| WO | PCT/US2013/048521 | | 6/2013 |
| WO | WO-2014/018221 | A1 | 1/2014 |
| WO | PCT/US2015/035783 | | 6/2015 |
| WO | WO-2016/010659 | A1 | 1/2016 |

OTHER PUBLICATIONS

Non-Final Office Action issued by the USPTO dated Aug. 13, 2015 for U.S. Appl. No. 14/417,726, filed Jan. 27, 2015 and published as U.S. 2015/0191856 on Jul. 9, 2015 (Applicant—Drifire LLC // Inventor—Hines, et al.) (18 pages).

Response to Non-Final Office Action filed on Nov. 11, 2015 for U.S. Appl. No. 14/417,726, filed Jan. 27, 2015 and published as U.S. 2015/0191856 on Jul. 9, 2015 (Applicant—Drifire LLC // Inventor—Hines, et al.) (18 pages).

Non-Final Office Action issued by the USPTO dated Dec. 4, 2015 for U.S. Appl. No. 14/417,726, filed Jan. 27, 2015 and published as U.S. 2015/0191856 on Jul. 9, 2015 (Applicant—Drifire LLC // Inventor—Hines, et al.) (15 pages).

Final Office Action issued by the USPTO dated Apr. 21, 2016 for U.S. Appl. No. 14/417,726, filed Jan. 27, 2015 and published as U.S. 2015/0191856 on Jul. 9, 2015 (Applicant—Drifire LLC // Inventor—Hines, et al.) (16 pages).

Response to Final Office Action filed on Sep. 19, 2016 for U.S. Appl. No. 14/417,726, filed Jan. 27, 2015 and published as U.S. 2015/0191856 on Jul. 9, 2015 (Applicant—Drifire LLC // Inventor—Hines, et al.) (43 pages).

Non-Final Office Action issued by the USPTO dated Oct. 19, 2016 for U.S. Appl. No. 14/417,726, filed Jan. 27, 2015 and published as U.S. 2015/0191856 on Jul. 9, 2015 (Applicant—Drifire LLC // Inventor—Hines, et al.) (14 pages).

International Search Report and Written Opinion of the International Searching Authority for application PCT/US2015/035783, filed on Jun. 15, 2015 and published as WO 2016/010659 on Jan. 21, 2016 (Applicant—Drifire, LLC // Inventor—Hines, et al.) (15 pages).

International Preliminary Report on Patentability dated Nov. 3, 2016, for application PCT/US2015/035783, filed on Jun. 15, 2015 and published as WO 2016/010659 on Jan. 21, 2016 (Applicant—Drifire, LLC // Inventor—Hines, et al.) (10 pages).

First Office Action issued by the State Intellectual Property Office of People's Republic of China dated Jan. 13, 2016 for application 201380044738.1, filed on Jun. 28, 2013 and published as CN 10736750A on Jun. 24, 2015 (Applicant—Drifire, LLC // Inventor—Hines, et al.) (Original—20 pages // Translation—29 pages).

Second Office Action issued by the State Intellectual Property Office of People's Republic of China dated Sep. 6, 2016 for application 201380044738.1, filed on Jun. 28, 2013 and published as CN 10736750A on Jun. 24, 2015 (Applicant—Drifire, LLC // Inventor—Hines, et al.) (Original—19 pages // Translation—32 pages).

Extended European Search Report dated Jul. 19, 2016 for application EP 13822850.7, filed on Jun. 28, 2013 and published as EP 2877619 on Jun. 3, 2015 (Applicant—Drifire, LLC // Inventor—Hines, et al.) (9 pages).

Examination Report issued by IP Australia dated Sep. 8, 2016 for application AU 2013293487, filed on Jun. 28, 2013 (Applicant—DriFire, LLC // Inventor—Hines, et al.) (3 pages).

Examination Report issued by IP Australia dated Sep. 16, 2016 for application AU 2015224518, filed on Jun. 15, 2015 (Applicant—DriFire, LLC // Inventor—Hines, et al.) (2 pages).

International Search Report and Written Opinion dated Oct. 11, 2013 for International Patent Application No. PCT/US2013/048521, which was filed Jun. 27, 2013 and published as WO 2014/018221 on Oct. 10, 2013 (Inventor—Robert W. Hines ; Applicant—Drifire, LLC;) (11 pages).

International Preliminary Report on Patentability dated Nov. 5, 2014 for International Patent Application No. PCT/US2013/048521, which was filed Jun. 27, 2013 and published as WO 2014/018221 on Oct. 10, 2013 (Inventor—Robert W. Hines ; Applicant—Drifire, LLC;) (20 pages).

U.S. Appl. No. 61/676,518, filed Jul. 27, 2012, Hines (Drifire, LLC).

U.S. Appl. No. 14/417,726, filed Jan. 27, 2015, Hines (2015/0191856), (Jul. 9, 2015), (Drifire, LLC).

U.S. Appl. No. 62/024,619, filed Jul. 15, 2014, Hines (Drifire, LLC).

* cited by examiner

LIGHTWEIGHT, DUAL HAZARD FABRICS

CROSS-REFERENCE TO RELATED APPLICATIONS

This application is a U.S. National Phase Application of International Application No. PCT/US2015/035783, filed Jun. 15, 2015, which claims the benefit of U.S. Provisional Application No. 62/024,619, filed Jul. 15, 2014, each of which are hereby incorporated by reference in their entirety.

FIELD OF THE INVENTION

The present invention generally relates to performance fabrics. More particularly, the invention relates to lightweight fabrics with a balance of thermal, durability, and comfort properties and to the garments and article made from the fabrics.

BACKGROUND OF THE INVENTION

Flame resistant fabrics (also variously referred to as "FR", "fire-resistant," "flame-retardant," and "fire-retardant" fabrics) are fabrics that, once ignited, tend not to sustain a flame, when the ignition source is removed. Considerable research has been directed toward the development and improvement of flame-resistant fabrics for use in various products, including clothing and bedding. Flame-resistant clothing is often worn by workers involved in activities, such as industrial manufacturing and processing (such as oil, gas, and steel industries), fire-fighting, electrical utility work, military work, and other endeavors that entail a significant risk of being exposed to open flame, flash fire, momentary electrical arcs, and/or molten metal splash. Non flame resistant work clothes can ignite and will continue to burn even after the ignition source has been removed. Untreated natural fabrics will continue to burn until the fabric is totally consumed and non-flame resistant synthetic fabrics will burn with melting and dripping, causing severe contact burns to the skin. A significant portion of severe and fatal burn injuries are due to the individual's clothing igniting and continuing to burn, not due to the initial exposure itself. Abrasion resistance of protective fabrics is also important, as garments that have developed failures, such as holes and rips, can compromise the protective properties of the fabric.

Flame-resistant fabrics include both fabrics that are treated to be flame-resistant as well as fabrics made from inherently flame-resistant fibers. The former types of fabrics are not themselves flame-resistant, but are made flame resistant by applying to the fabric a chemical composition that renders the fabric resistant to flame. These types of fabrics are susceptible to losing their flame resistance with repeated launderings with hypochlorite bleach. Hypochlorite bleach attacks the finish and reduces the flame-resistant properties of the fabric. In contrast, inherently flame-resistant fabrics do not suffer from this drawback because they are made from fibers that are themselves flame-resistant. The use of flame resistant clothing provides thermal protection to areas of the body covered by the garment. The level of protection typically rests in the fabric weight, construction, and composition. After the ignition source is removed, a flame resistant garment will self-extinguish, limiting the body burn percentage.

Flame-resistant fabrics may contain a low percentage of natural fibers and have limited comfort properties, such as water absorption and breathability. Flame-resistant fabrics are most often worn in work environments, where comfort, including absorption of sweat from the skin, is an important performance factor, especially in extreme conditions such as firefighting. Combining some percentage of natural hydrophilic fibers with FR fibers may provide some improvement in comfort and moisture wicking, however this typically comes at a loss of FR performance properties. Most FR fibers, including aramid fibers, are hydrophobic and do not provide high comfort performance. Adding a high concentration of hydrophilic fibers, however, may negatively impact moisture management properties and/or fire resistance properties. In addition, garments made from fabrics having high percentage content of hydrophilic fibers may become oversaturated with moisture, such as from sweat, and cause additional burns, when expose to a high temperature.

In addition, fabrics made with a high percentage of aramid fibers, including meta-aramid and/or para-aramid, fibers are typically stiff, have poor softness or drape properties, and are generally uncomfortable to wear. The softness of fabrics made with a high percentage of aramid fibers may be improved by repeated washings but tend to become more hydrophobic. Therefore, many industrial workers, pilots, and emergency responders repeatedly wash garments made with high percentages of aramid fibers to increase comfort, even washing new garments many times prior to the initial use. Unfortunately, many of these garments are made with hydrophobic and/or hydrophilic coatings that can lose effectiveness with repeated washings. Therefore, washed treated garments may have improved softness but decreased moisture management properties.

Various types of inherently FR fibers have been developed, including modacrylic fibers (e.g., modacrylic fibers sold under the PROTEX name from Kaneka Corporation of Osaka, Japan, and Tairylan sold by Formosa Plastics of Taiwan). Acrylic based FR fibers sold under the name PyroTex, (Hamburg, Germany), aramid fibers (e.g., meta-aramid fibers sold under the NOMEX name and para-aramid fibers sold under the KEVLAR name, both from E.I. DuPont de Nemours and Company of Wilmington, Del.), FR rayon fibers (sold under the Lenzing FR name, from Lenzing Group, Austria), oxidized polyacrylonitrile fibers, and others. It is common to blend one or more types of FR staple fibers with one or more other types of non-FR staple fibers to produce a fiber blend from which yarn is spun; the yarn then being knitted or woven into fabrics for various applications. In such a fiber blend, the FR fibers render the blend flame-resistant even though some fibers in the blend may themselves be non-FR fibers, because, in the case of antimony- and halogen-filled fibers, when the FR fibers are exposed to heat and flame they release non-combustible gases that tend to displace oxygen and thereby extinguish any flame. In addition to char formation, and having high Oxygen Limiting Index (LOI), many FR fibers are poor conductors of heat. In the case of non-filled FR fibers the high percentage of FR fibers form char, or exhibit other characteristics which provide wearer protection.

In addition to the above-noted performance specifications of fabrics, other properties are also important if a fabric is to be practical and commercially viable, particularly for clothing. For instance, the fabric should be durable under repeated industrial and home launderings and should have good abrasion-resistance. Furthermore, the fabric should be comfortable to wear. Unfortunately, many of the FR blends are not comfortable under typical environmental conditions. In such cases, wearers tend to be less likely to be compliant and thereby decreasing the probability that the wearer will continue to use the garment as intended. Thus, it is beneficial if a FR fabric exhibits good moisture management properties, i.e., ability to wick away sweat and dry quickly, so that the wearer does not become overheated or chilled, and/or the fabric does not irritate the wearer's skin.

Furthermore, many inherently FR fibers and especially most aramid type FR fibers are not dye accepting. It is desirable in most applications to have FR fabric that is dye accepting or "printable". In some cases, fibers may be purchased that are producer colored, however this limits the color options available to the fabric manufacturer.

Selection of a fiber blend to meet a plurality of the requirements as described, while being affordable is a constant challenge. Some (FR) fibers and especially inherently FR fibers that are thermally shrink resistant, as defined herein, are relatively expensive and incorporating a high percentage of these fibers into a yarn and fabric may be cost prohibitive for many applications.

Woven FR fabrics are well suited for meeting the requirements of the FR test protocols, including NFPA 2112 and especially the thermal shrinkage tests. Woven fabrics are relatively tight, having little void volume between yarns, therein reducing the propensity to thermally shrink. Other types of fabric structures, such as knits, may be more comfortable to wear as they typically have higher porosities. However, knit fabric may not meet the thermal shrinkage requirements. The yarns in a knit fabric are looped and therefore not as restrained as yarns in a conventional woven fabric and therefore can shrink more.

One of the hazards to which workers are exposed is arc flash, which is an explosive release of energy caused by an electrical arc. An arc flash results from either a phase to ground or a phase to phase fault caused by, for example, accidental contact with electrical systems, accumulation of conductive dust, corrosion, dropped tools, and improper work procedures. During an arc flash, the temperature can reach 35,000° F., and exposure to an arc flash can result in serious burn injury and death.

Arc rating is the value of energy necessary to pass through any given fabric to cause with 50% probability a second or third degree burn. This value is measured in calories/cm$^2$. The necessary arc rating for an article of clothing is determined by a Hazard/Risk Assessment and the resulting Hazard Risk Category, and is typically measured in terms of arc thermal performance value (ATPV) or energy break open threshold (EBT). For a fabric to be considered useful in most job situations, an arc rating of at least 8 calories/cm$^2$ is required. In the trade, fabrics that meet both an arc rating of at least 8 calories/cm$^2$ and NFPA 2112 are considered dual hazard. Arc rating determines the protective characteristics of the fabric and the higher the arc rating value the greater the protection.

The primary purpose of FR fabric is to resist ignition (as tested by ASTM D-6413, also known as Vertical Flame Test). If fabric is ignited by an arc flash, flash fire, molten metal, and like, the hazard to the wearer instantaneously escalates, because the fire will last much longer than the initial hazard, will typically burn the victim over a much larger body surface area and more deeply, and is more likely to result in airway and lung damage. By not continuing to burn after the initial hazard is over, FR fabric limits burn injury to, at most, only the body surface area directly impacted by the hazard. Limiting the total body surface area greatly improves survival for the victim. The second goal of FR fabric is to insulate the wearer from the thermal hazard, thus reducing or eliminating any second or third degree burn through the fabric, even in areas directly impacted by the hazard. Arc rating measures the protective value of the fabric to this hazard.

Since all arc rated fabrics are also FR, they will provide some measure of protection in a flash fire. However, arc rating is not predictive of flash fire performance, which must be separately tested. The consensus standard for flash fire is NFPA 2112 Standard on Flame-resistant garments for protection of industrial personnel against flash fire. NFPA 2112 lists multiple requirements for certification to the standard including ASTM F 1930: Standard Test Method for Evaluation of Flame Resistant Clothing for Protection Against Fire Simulations Using an Instrumented Manikin. A fabric passes this test if it records less than 50% in second and third degree body burns in a three-second flash fire, expressed as a percent body burn. The lower value the better the fabric performs.

To improve arc rating, garment manufacturers adjust the fabric weight, composition, and construction. For example, increasing the weight of the fabric typically improves the arc rating. Unfortunately, increased fabric weight can make garments uncomfortable, bulky, and stiff and may lead to non-compliance by the wearer. Also, for lighter weight fabrics, such as those used in undergarments, it may not be possible to achieve the arc rating and flash fire resistance, required by workers in high hazard fields, such as utility workers, industrial works, fire fighters, and military personnel. Thus, there exists a need for lightweight, dual hazard (arc rated and flash fire resistant) fabrics, which also provide superior moisture management properties and strength properties to improve wearer compliance. The fabrics, garments, and articles of the present invention are directed toward these, as well as other, important ends.

SUMMARY OF THE INVENTION

The invention relates generally to lightweight, dual hazard (arc rated and flash fire resistant) fabrics, which also provide superior moisture management properties and strength properties to improve wearer compliance. Fabrics made with the spun yarn of the present invention achieve a balance of high thermal properties, including arc resistance and flash fire resistance, as well as durability and moisture management properties to provide both protection and comfort to the wearer. In addition, the fabrics of the present invention are dye accepting and/or may be printed thereon.

Accordingly, one embodiment the invention is directed to fabrics, comprising:

a spun yarn comprising:

about 44% by weight to about 80% by weight, based on the total weight of the spun yarn, meta-aramid fiber;

greater than about 0% by weight to about 15% by weight, based on the total weight of the spun yarn, nylon fiber;

about 5% by weight to about 15% by weight, based on the total weight of the spun yarn, para-aramid;

less than 2% by weight, based on the total weight of the spun yarn, anti-static fiber, and about 10% by weight to about 15% by weight, based on the total weight of the spun yarn, fire-resistant hydrophilic fiber;

wherein said fibers are intimately blended; and wherein said fabric has a weight of less than about 6.5 oz/yd$^2$.

Another embodiment the invention is directed to fabrics, comprising:

a spun yarn comprising:

about 66% by weight, based on the total weight of the spun yarn, meta-aramid fiber;

about 9% by weight, based on the total weight of the spun yarn, nylon fiber; about 12% by weight, based on the total weight of the spun yarn, para-aramid;

about 1% by weight, based on the total weight of the spun yarn, anti-static fiber; and about 12% by weight, based on the total weight of the spun yarn, FR rayon;

wherein said fibers are intimately blended; and wherein said woven fabric has a weight of less than about 6.5 oz/yd$^2$.

In other embodiments, the fabric is incorporated into articles, including garments and linens, especially those used requiring both arc rating and flash fire resistance.

Fabrics made from the spun yarns described herein may have an initial softness that makes them comfortable to wear as received, and may not require repeated washing to reduce stiffness.

The summary of the invention is provided as a general introduction to some of the embodiments of the invention, and is not intended to be limiting. Additional example embodiments, including variations and alternative configurations, of the invention are provided herein.

DETAILED DESCRIPTION OF THE ILLUSTRATED EMBODIMENTS

As employed above and throughout the disclosure, the following terms, unless otherwise indicated, shall be understood to have the following meanings.

As used herein, the terms "comprises," "comprising," "includes," "including," "has," "having" or any other variation thereof, are intended are open-ended and cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" is employed to describe elements and components described herein. This is done merely for convenience and to give a general sense of the scope of the invention. This description should be read to include "one" or "at least one" and the singular also includes the plural, unless it is obvious that it is meant otherwise by the context.

As used herein, with reference to spun yarn, fabric, or articles such as garments made therefrom, the term "consisting essentially of" means that the yarn, fabric, or article is made primarily of a described component or components, such as a polymer, material, or fiber type and may include small amounts, generally less than about 5%, preferably less than about 2%, even more preferably less than about 1% by weight, based on the total weight, of additional treatments, coating, or finishes.

As used herein, with reference to fabric, the term "formed substantially of" means that the fabric includes at least about 50% by weight, based on the total weight of the fabric, preferably at least about 75% by weight, based on the total weight of the fabric, more preferably, at least about 80% by weight, based on the total weight of the fabric and even more preferably at least 90% by weight, based on the total weight of the fabric, of a specific fiber blend or spun yarn composition. It is to be understood that a fabric, as described herein, may comprise additional coatings or additives, as required for various applications.

As used herein, the term "aramid fiber" refers to a manufactured fiber in which the fiber-forming substance is a long-chain synthetic polyamide in which at least 85% of the amide linkages, (—CO—NH—), are attached directly to two aromatic rings, including, but not limited to, para-aramid (p-aramid) and meta-aramid (m-aramid). Aramid fiber is a strong, heat-resistant fiber formed of polymers with repeating aromatic groups branching from a carbon backbone, used in materials for bulletproof vests and radial tires. Examples of para-aramids include, but are not limited to, (poly(p-phenylene terephthalamide), e.g., KEVLAR® duPont de Nemours and Company), TWARON® (Teijin Twaron BV), and TECHNORA by Teijin Company. KEVLAR is a para-aramid fiber having a very high tenacity of between 28 and 32 grams/denier and outstanding heat resistance. Examples of meta-aramids include, but are not limited to, (poly(m-phenylene isophthalamide), such as NOMEX® (E.I. du Pont de Nemours and Company) and CONEX® (Teijin Twaron BV). Unlike Kevlar, Nomex cannot align during filament formation and is typically not as strong as para-aramid or KEVLAR. Meta-aramid, however, has excellent thermal, chemical, and radiation resistance. Aramid fibers feature excellent thermal stability and are highly non-flammable. These fibers have a very high resistance to heat and are resistant to melting, dripping and burning at a temperature of at least 700° F. Moreover, their Limiting Oxygen Index (LOI) value is preferably in the range of between about 28 and about 30. The LOI represents the minimum $O_2$ concentration of an $O_2/N_2$ mix required to sustain combustion of a material. The LOI is determined by the ASTM Test D 2862-77. Meta-aramids and para-aramids are inherently hydrophobic but in some cases may be treated to render them hydrophilic, at least temporarily. In an exemplary embodiment, the fiber blend as described herein is comprised of a majority of aramid fibers, such as about 66% by weight meta-aramid and about 12% by weight para-aramid, based on the total weight of the spun yarn.

Most aramid fibers are not dye accepting and, when incorporated into a fiber blend in a high concentration, can significantly limit the color ranges possible for a fabric. However, some aramid fibers are printable, or dye accepting. For example, a low-crystallized type meta-aramid fiber, such as NOMEX® 462 available from E.I. du Pont de Nemours and Company, is a printable meta-aramid. In addition, some meta-aramid fibers are available as producer-colored meta-aramids, wherein fibers are colored during manufacturing of the fibers.

As used herein, the term "modacrylic fiber" refers to an acrylic synthetic fiber made from a polymer comprising primarily residues of acrylonitrile, especially polymers that have between 35 to 85% acrylonitrile units, and which may be modified by other monomers. Modacrylic fibers are spun from an extensive range of copolymers of acrylonitrile. The modacrylic fiber may contain the residues of other monomers, including vinyl monomer, such as but not limited to vinyl chloride, vinylidene chloride, vinyl bromide, vinylidene bromide, and the like. The types of modacrylic fibers that can be produced within this broad category are capable of wide variation in properties, depending on their composition. FR acrylic derivative fibers, as used herein includes modacrylic fibers as described herein and any fiber comprising acrylic monomer units, including acrylic FR fibers sold under the name Pyre-Tex, (Hamburg, Germany). Some examples of commonly available modacrylics are PROTEX™, KANEKALON™, KANECARON™ by Kaneka Corporation. Modacrylic fibers have excellent fire retardancy performance combined with non-melt, non-drip and self-extinguishing properties. Modacrylics have a high so-called LOI value as compared with other fibers.

As used herein, the term "anti-static fiber" or conductive refers to a fiber that, when incorporated into a fabric or other material, eliminates or reduces static electricity. Suitable fibers include, but are not limited to, metal fibers (steel, copper or other metal), metal-plated polymeric fibers, and polymeric fibers incorporating carbon black on the surface and/or in the interior of the fiber, such as those described in U.S. Pat. No. 3,803,453, U.S. Pat. No. 4,035,441, U.S. Pat. No. 4,107,129, and the like. Anti-static carbon fiber is a preferred anti-static fiber. One example of a conductive fiber is NEGASTAT®, produced by E.I. du Pont de Nemours and Company, a carbon fiber comprising a carbon core of conductive carbon surrounded by a non-conductive polymer cover, either nylon or polyester. Another anti-static fiber example is RESISTAT®, available from Shakespeare Conductive Fibers LLC; a fiber where the fine carbon particles are embossed on the surface of a nylon filament. By way of example, a steel wire is available under the names BEKINOX and BEKITEX from Bekaert S.A. in a diameter as small as 0.035 millimeter. Another anti-static fiber is the product X-static made by Noble Fiber Technologies, a nylon fiber coated with a metal (silver) layer. The X-static fibers may be blended with other fibers, such as meta-aramid, in the process of yarn spinning.

As used herein, the term "nylon fiber" refers to a fiber consisting essentially of a polyamide synthetic polymer. Polyamide is a thermoplastic having high abrasion resistance and toughness. Addition of nylon fiber to the fiber blend may increase abrasion resistance of a fabric.

As used herein, the term "cellulosic fiber" refers to a fiber that comprises a substantial concentration of cellulosic and/or cellulosic derivative material. A cellulosic fiber may comprise any suitable type or combination of cotton, fire-resistant cotton, rayon, fire-resistant rayon, viscose, Lyocell, acetate, bast fibers (such as linen, jute, hemp, and raime), bamboo, soy, and combinations thereof. A cellulosic derivative fiber may comprise a treatment to render it flame resistant. In most cases, a cellulosic derivative fiber is inherently hydrophilic. However, a cellulosic derivative fiber may comprise treatments to render the fiber hydrophobic, hydrophilic, or oleophobic.

As used herein, the term "hydrophilic," as it refers to a fabric, means that the fabric has a horizontal wicking of less than about twenty seconds. A yarn or blend of yarns may be considered to be hydrophilic when a fabric made exclusively therefrom has a horizontal wicking time of less than about ten seconds and more preferably less than five seconds based upon the AATCC 79 Test Method for horizontal wicking. In an exemplary embodiment, the hydrophilic fiber component consists essentially of hydrophilic fiber selected from the group consisting of selected from cellulosic fibers, wool, and combination thereof. In an exemplary embodiment, the hydrophilic fiber consists essentially of cellulosic fibers, wool, FR acrylic derivative fiber and combinations thereof.

As used herein, the term "basis weight" refers to a measure of the weight of a fabric per unit area. Typical units include ounces per square yard and grams per square centimeter.

As used herein, the term "garment" refers to any article of clothing or clothing accessory worn by a person, including, but not limited to underwear (such as t-shirts and thermal underwear), socks, outer wear (such as coats, shirts, pants, coveralls, overalls, firefighter turnout coats, combat and flight, and the like), footwear (such as shoes, boots, socks, and the like), headwear (such as hood, hats, balaclavas, headbands, and the like), sleepwear, swimwear, belts, gloves, wristbands, and liners thereof.

As used herein, the term "linen" (when not in relation to the hydrophilic fiber) refers to any article used to cover: (a) a user (human or animal); (2) any article to cover a seating or used by a user (human or animal); (3) an article to cover an architectural features (such as a door or window). Non-limiting representative examples include, but are not limited to sheets, blankets, draperies, upholstery covering, vehicle upholstery covering, and mattress covering.

As used herein, the term "intimately blended," when used in conjunction with a yarn, refers to a statistically random mixture of the staple fiber components in the yarn.

The invention relates generally to spun yarns comprising a fiber blend and to fabrics and articles comprising the spun yarns that achieve a balance of high thermal properties, including arc resistance and flash fire resistance, as well as durability and moisture management properties to provide both protection and comfort to the wearer. In addition, a spun yarn, fabric or article made therefrom of the present invention may be dye accepting and/or can be printed thereon. In yet another embodiment, a fabric made from a spun yarn described herein has (1) flash fire resistance of at less than about 35% total body burn (3 seconds); (2) high moisture management properties with a vertical wicking height of at least about 10 cm; and (3) a comfort zone drying time less than about 20 minutes, even when the basis weight of the fabric is less than about 6.5 oz/yd$^2$.

Accordingly, one embodiment the invention is directed to a fabric, comprising:

a spun yarn comprising:

about 44% by weight to about 80% by weight, based on the total weight of the spun yarn, meta-aramid fiber;

about 0% by weight to about 15% by weight, based on the total weight of the spun yarn, nylon fiber;

about 5% by weight to about 15% by weight, based on the total weight of the spun yarn, para-aramid;

less than 2% by weight, based on the total weight of the spun yarn, anti-static fiber, and about 10% by weight to about 15% by weight, based on the total weight of the spun yarn, fire-resistant hydrophilic fiber;

wherein said fibers are intimately blended; and wherein said fabric has a weight of less than about 6.5 oz/yd$^2$.

Another embodiment the invention is directed to a fabric, comprising:

a spun yarn comprising:

about 66% by weight, based on the total weight of the spun yarn, meta-aramid fiber;

about 9% by weight, based on the total weight of the spun yarn, nylon fiber;

about 12% by weight, based on the total weight of the spun yarn, para-aramid;

about 1% by weight, based on the total weight of the spun yarn, anti-static fiber; and about 12% by weight, based on the total weight of the spun yarn, FR rayon;

wherein said fibers are intimately blended; and wherein said woven fabric has a weight of less than about 6.5 oz/yd$^2$.

In certain embodiments, the anti-static fiber is present at a level of less than about 1.5% by weight, based on the total weight of the spun yarn. In other embodiments, the antistatic fiber is present at a level of less than about 1.25% by weight, based on the total weight of the spun yarn.

In certain embodiments, the fabric has a basis weight of less than about 6.0 oz/yd$^2$. In other embodiments, the fabric has a basis weight of less than about 5.5 oz/yd$^2$. In yet other embodiments, the fabric has a basis weight of less than about 5.0 oz/yd$^2$. In further embodiments, the fabric has yet even more preferably about 4.5 oz/yd$^2$. In certain embodiments, the fabric has a basis weight of about 4.0 oz/yd$^2$ to less than about 6.5 oz/yd$^2$, preferably less than about 6.0 oz/yd$^2$, more preferably less than about 5.5 oz/yd$^2$, and even more preferably less than about 5.0 oz/yd$^2$.

In certain embodiments, the meta-aramid fiber is present at a level of about 60% by weight to 70% by weight, based on the total weight of the spun yarn. In certain embodiments, the meta-aramid fiber is present at a level of about 65% by weight to 70% by weight, based on the total weight of the spun yarn.

In certain embodiments, the nylon fiber is present at a level of about 8% by weight to about 15% by weight, based on the total weight of the spun yarn. In certain embodiments, the nylon fiber is present at a level of about 9% by weight to about 12% by weight, based on the total weight of the spun yarn.

In certain embodiments, the para-aramid fiber is present at a level of about 8% by weight to 15% by weight, based on the total weight of the spun yarn. In certain embodiments, the para-aramid fiber is present at a level of about 9% by weight to 12% by weight, based on the total weight of the spun yarn.

In certain embodiments, the fire-resistant hydrophilic fiber is present at a level of about 12% by weight to about 15% by weight, based on the total weight of the spun yarn. In certain embodiments, the fire-resistant hydrophilic fiber is present at a level of about 10% by weight to about 12% by weight, based on the total weight of the spun yarn. In certain other embodiments, the fire-resistant hydrophilic fiber is present at a level of about 10% by weight to about 13% by weight, based on the total weight of the spun yarn.

In certain embodiments, the fire-resistant hydrophilic fiber (s) is (are) inherently fire resistant. In other embodiments, the fire-resistant hydrophilic fibers are treated to make them fire resistant. In certain embodiments, the hydrophilic fiber is selected from the group consisting of cellulosic fiber, wool fiber, silk fiber, fire resistant acrylic derivative fiber, and combinations thereof. In certain embodiments, the cellulosic fiber is selected from the group consisting of cotton, fire-resistant cotton, rayon, fire-resistant rayon, viscose, Lyocell, acetate, bast fibers (such as linen, jute, hemp, and raime), bamboo, soy, and combinations thereof. In certain other embodiments, the cellulosic fiber is fire-resistant rayon.

In certain embodiments, the spun yarn comprises:

about 85% by weight to about 90% by weight, based on the total weight of the spun yarn, hydrophobic component; and about 10% by weight to about 15% by weight, based on the total weight of the spun yarn, hydrophilic component. In certain embodiments, the hydrophilic component is selected from the group consisting of cellulosic fiber, wool fiber, silk fiber, fire resistant acrylic derivative fiber, and combinations thereof. In certain embodiments, the hydrophobic component is selected from the group consisting of meta-aramid fiber, para-aramid fiber, nylon fiber, anti-static fiber, and combinations thereof.

In certain embodiments, the spun yarn consists essentially of:

about 85% by weight to about 90% by weight, based on the total weight of the spun yarn, hydrophobic component; and about 10% by weight to about 15% by weight, based on the total weight of the spun yarn, hydrophilic component.

In certain embodiments, the fabric is printable.

In certain embodiments, the meta-aramid fiber has low crystallinity. In certain embodiments, the meta-aramid fiber is dyed or producer colored. In certain embodiments, the meta-aramid fiber may be printable, whereby it may accept a dye. In some embodiments, the meta-aramid component is a printable meta-aramid that is specifically engineered for accepting dyes and/or prints. A printable meta-aramid may comprise a low-crystallized type meta-aramid. NOMEX® 462 is a printable type of meta-aramid, available from E.I. du Pont de Nemours, Wilmington, Del. In another exemplary embodiment, a producer-colored meta-aramid may be used in the fiber blend, described herein. In addition, any combination of printable and producer colored meta-aramids may be used in the fiber blend.

The para-aramid fiber component may be a dyed or producer colored. In one embodiment, both the para-aramid and meta-aramid are colored.

In certain embodiments, at least about 85 weight % of the fibers in the spun yarn are flame resistant.

In certain embodiments, the anti-static fiber comprises a conductive fiber. In certain embodiments, the anti-static fiber comprises a carbon fiber with a nylon sheath.

In certain embodiments, the spun yarn further comprises an elastomeric filament. In certain embodiments, the fabric is a two-way stretch fabric. In certain embodiments, the fabric is a four-way stretch fabric.

In certain embodiments, the spun yarn is configured into a plied yarn having counts of about 20/2 and about 40/2 or an effective 10 to 20 Ne. In certain embodiments, the spun yarn is configured into a plied yarn having counts of about 40/2, about 36/2, about 33/2, about 30/2, about 28/2, and about 24/2 or about 20/1, about 18/1, about 16.5/1, about 15/1, and about 14/1, and ranges of any combination of end points thereof.

In certain embodiments, articles are formed from the inventive fabrics of the invention. In certain embodiments, the article is a garment or linen.

A hydrophilic fiber component of the fiber blend described herein may comprise any suitable type or combination of hydrophilic fibers including, but not limited to, cellulosic fibers, wool, FR acrylic derivative fibers, or fibers rendered hydrophilic by the addition of a hydrophilic treatment. In one embodiment, a fiber is inherently hydrophilic, whereby it is hydrophilic without the addition of a hydrophilic treatment. In other embodiments, a fiber may be treated to render it hydrophilic.

In an exemplary embodiment, the anti-static fiber component of the spun yarn, described herein, is electrically conductive comprising, for example, carbon. In one embodiment, an anti-static fiber comprises a carbon fiber with a nylon sheath. Any suitable configuration of fibers may be used to form the anti-static fiber.

In certain embodiments, the invention is directed to yarns comprising the various fiber blends described herein, wherein said fibers are intimately blended. An intimate fiber blend may be formed into any suitable fabric, as described herein. The spun yarn as described herein may be formed into any suitable type of fabric in including, but not limited to, woven, knitted, or non-woven fabric. Nonwoven include, for example, hydroentangled, felts, thermal or point bonded, needle-punched, and wet-laid fabrics. Wovens include, for example, twill weaves, rip-stop, plain weaves, and denim weaves. In one embodiment, the fiber blend described herein may be formed into a knit fabric.

In certain embodiments, the spun yarn is plied whereby two yarns are plied providing improved softness, and hand, as well as increased durability and strength over a single ply yarn of the same weight. Any suitable number of yarns may be plied together including, but not limited to, two, three, four, five, more than five, and the like. In certain embodiments, the spun yarn is not plied (single yarn)

In certain embodiments, an elastomeric filament may be incorporated into a plied yarn, whereby the elastormeric filament is essentially covered, or wrapped by one or more spun yarns around the elastomeric filament. An elastomeric filament may comprise any suitable type of elastomeric material, including Spandex, silicone, fluoroelastomer, polyurethane, FR modified elastic, rubber and the like. A yarn having an elastomer filament may provide two way or four way stretch to a fabric made therefrom.

In some embodiments, the spun yarn, as described herein, is a flame resistant (FR) fiber blend, whereby fabric made therefrom meets NFPA 2112 requirement.

Fabrics made from the spun yarn described herein may have an initial softness that makes it comfortable to wear as received, and may not require repeated washing to reduce stiffness.

Fabrics made from the spun yarn described herein have moisture management properties, or combinations of moisture management properties that demonstrate comfort to a wearer. In addition, fabrics made from the spun yarn described herein may have durable moisture management properties, or performance properties that are not substantially affected by washing.

Fabrics made from the spun yarn described herein have thermal properties, or combinations of thermal properties that demonstrate the thermal protection provided to a wearer of the inventive fabric.

In certain embodiments, a fabric made from the spun yarn described herein may be formed into an article, such as a garment or linen. In certain embodiments, the fabric forms at least one outer portion of the garment or linen because of the protection it provides. A fabric made with the spun yarn described herein may be useful in garments such as outerwear, including, but not limited to coats, coveralls, overalls, shirts, and pants, and may be particularly useful in firefighter turnout coats, combat and flight suits. In other embodiments, a fabric may be formed into a garment, such as an undershirt, in a single tubular design to reduce the number of seams.

The present invention is further defined in the following Examples, in which all parts and percentages are by weight, unless otherwise stated. It should be understood that these examples, while indicating preferred embodiments of the invention, are given by way of illustration only. From the above discussion and these examples, one skilled in the art can ascertain the essential characteristics of this invention, and without departing from the spirit and scope thereof, can make various changes and modifications of the invention to adapt it to various usages and conditions.

EXAMPLES

The following test methods were used to evaluate exemplary embodiments and comparative materials, unless otherwise noted.

Comfort Testing

Water Weight Gain and Water Release Rate (WRR) Test Method

The water release rate (WRR) of materials made according to the present invention as well as comparative materials were measured according to AATCC MM TS-05A.

Gravimetric Drying Test Method (WRR, Drying Time and Wet Pick-Up)

The drying times of materials made according to the present invention as well as comparative materials were measured according to AATCC MM TS-05A.

For a typical test, four 2.5×2.5 inch square samples were used. Two of the samples were the "control" (reference) fabric and two were the "test" fabric of interest. Samples were conditioned in the conditioning room at temperature of 70° F. and 65% relative humidity for at least 4 hours prior to test. The samples were then weighed using a laboratory balance, accurate to 0.0001 g to establish the conditioned dry weight. Then 10 mL of distilled water was placed into a 25 ml beaker. Samples were submerged, one sample in the beaker for five to ten minutes, making certain that the sample was completely submerged under the water to insure complete wetting. Even samples exhibiting poor or no horizontal wicking, such as 100 seconds or more horizontal wicking time, absorb water if submerged as described. Samples were then removed from the beaker and sandwiched between two pieces of unused AATCC blotter paper and passed through a wringer (LabPro Padder). The samples were then left sandwiched in the wet blotters until removed and affixed to the vertical samples stand. A vertical sample stand comprising a wire loop supported by a foam base, wherein the top of the wire loop was approximately 15 cm above the top of the base and the parallel wire portions extending from the base were approximately 7.5 cm apart, was used for supporting the samples during drying. The vertical sample stand, and clips were placed on the balance and the balance was tared. The blotted wet sample was attached to the top of the wire loop using the clips, such that the sample hung down within the wire loop. The weight of the sample was recorded to establish a wet weight. The difference in the wet weight and the conditioned dry weight was recorded and was provided as the Wet Pick-Up value. The balance was coupled to a data acquisition system comprising Lab View software. Weight readings were automatically recorded every 15 seconds by the computer. The test was complete once the sample weight had reached a designated stopping moisture level versus the conditioned dry weight. The stopping moisture level was approximately 0.5% to 1%. The test was ended by stopping data acquisition in Lab View. The data file was saved for that sample.

Calculation and Interpretation

Total drying time is the time it takes the specimen to reach the stopping weight.

Total water release rate ("WRR", g/min) was calculated as follows:

Total WRR=(wet specimen weight−ending specimen weight)/(total drying time)

WRR, total (%) is calculated from the respective total WRR values as follows:

$$WRR_{total}=100\times(WRR_{test}-WRR_{control})/WRR_{control}$$

"Comfort Zone" drying time (min) is the time it takes the specimen's moisture content to decrease from 20% to approximately 1%.

"Comfort Zone" WRR (g/min) was calculated as follows:

Active WRR=(wet specimen weight ending specimen weight)/("active" drying time)

WRR (Comfort Zone) was calculated in the same manner as for WRR (total), except using test and control WRR (Comfort Zone) values.

Vertical wicking (AATCC MM TS-06 Vertical Wicking-Modified-Hanes Protocol)

The purpose of this test is to determine the rate at which water will wick vertically up test specimens suspended in water. A flat dish capable of holding 500 ml of distilled water was filled with 200 ml of water. Samples of fabric approximately 10 cm in length (warp) and width (weft) direction were cut for evaluation. A paper clip was attached to the bottom of the sample to ensure submerging the lower end of the sample. A top end was attached with a binding clip to a horizontal bar making sure the bottom paper clip will be submerged into the water. The sample was lowered into the dish and timed in minutes until the water traveled up the sample to a height of 2 cm. Also after 3 and 5 minutes the distance travelled by the water was noted as vertical wicking length. Final wicking length was the average of warp and weft wicking length after 5 minutes.

Moisture Vapor Transmission

The rate of moisture vapor diffusion through the fabric is determined according to the Simple Dish Method, similar to ASTM E96-80. A sample is placed on a water dish (82 mm in diameter and 19 mm in depth) allowing a 9 mm air space between the water surface and specimen. A vibration free turntable carrying eight dishes rotates uniformly at 5 meters per minute to insure that all dishes are exposed to the same average ambient conditions during the test. The assembled specimen dishes are allowed to stabilize for two hours before taking the initial weight. They are weighed again after a 24 hour interval. Then the rate of moisture vapor loss (MVTR) is calculated in units of g/cm$^2$-24 hours. A higher MVTR value indicates there is a greater passage of moisture vapor through the sample.

Durability Testing

Dry Abrasion Resistance (ASTM D 4966)

Test Method followed was Modified ASTM D 4966—Abrasion Resistance of Textile Fabrics (Martindale Abrasion Tester Method) 2. Abradant used was 600 ultrafine grit 3M (9084NA) sandpaper and the fabric was subject to 9 kPa of pressure.

Tensile Strength (ASTM D5034-09(2013))

The grab test procedure in this test method for the determination of breaking force and elongation is considered satisfactory for acceptance testing of commercial shipments of most woven or nonwoven textile fabrics, and the modified grab test procedure is considered satisfactory for acceptance testing of commercial shipments of most woven textile fabrics, since the procedures have been used extensively in the trade for acceptance testing.

Tear Resistance (ASTM D1424-09(2013))

Tear resistance was performed in accordance with ASTM D1424-09(2013), which is a standard test method for measuring fabric tearing strength using a falling-pendulum (Elmendorf-type) apparatus.

Thermal Properties Testing

Flash Fire Test Results: Manikin Test

ASTM F1930-99 is a full-scale mannequin test designed to test fabrics in completed garment form in a simulated flash fire. A mannequin, with up to 122 heat sensors spaced around its body, is dressed in the test garment, and then exposed to a flash fire for a pre-determined length of time. Tests are usually conducted at heat energies of 1.8-2 cal/cm$^2$ sec, and for durations of 2.5 to 5.0 seconds for single layer garments. Results are reported in percentage of body burn. For consistency in data and accuracy of comparison, the test method defines a standard garment size and configuration that must be used on each test. Test garments were tested over a 100% cotton T-Shirt and briefs per NFPA 2112 Standard on Flame-Resistant Garments for Protection of Industrial Personnel Against Flash Fire.

Arc Rating (ASTM F 1959/F 1959M—06ae1)

This test method was used to measure the arc rating of materials intended for use as flame resistant clothing for workers exposed to electric arcs that would generate hear flux rates from 84 to 120 kW/m$^2$ (2 to 600 cal/cm$^2$ s). This test method will measure the arc rating of materials that meet the following requirements: less than 150 mm (6 inches) char length and less than 2 seconds after flame, when tested in accordance with Test Method D 6413A.

Nine woven fabrics were tested. Fabric 1 (basis weight of 4.5 oz/yd$^2$) was an inventive woven fabric being formed from a spun yarn of an intimate blend of 66% m-aramid, 12% FR rayon, 12% p-aramid, 9% nylon, and 1% conductive fiber. Fabrics 2 to 9 were comparative fabrics. The compositions and test results are shown in the following table.

| | | Comfort Data | | | | | | |
|---|---|---|---|---|---|---|---|---|
| Fabric | Blend Composition | Basis Weight oz/yd$^2$ | Horizontal Wick seconds | Vertical Wicking Length in 5 minutes cm | Total Drytime (Total-2% Moisture) minutes | Drytime in Comfort Zone (20-2% Moisture) minutes | Water Release Rate (Total-2% Moisture) %/min | Water Release Rate in Comfort Zone (20-2% Moisture) %/min |
| Fabric 1 | 66% m-aramid/12% FR rayon/12% p-aramid/9% nylon/1% conductive (carbon core with nyion sheath) | 4.5 | 0 | 11.7 | 29.5 | 19.4 | 1.06 | 0.96 |

-continued

| | | | | | | | | |
|---|---|---|---|---|---|---|---|---|
| Fabric 2 (comparative) | 63% m-aramid/15% FR rayon/10% p-aramid/9% nylon/3% conductive | 4.5 | 0 | 9.1 | 35.5 | 22.5 | 0.94 | 0.83 |
| Fabric 3 (comparative) | 92% m-aramid/5% p-aramid/3% antistatic | 4.5 | 20+ | 4.1 | 28.8 | 21.8 | 0.93 | 0.85 |
| Fabric 4 (comparative) | 35% FR rayon/28% modacrylic/20% acrylic/15% aramid/2% nylon | 5.5 | 3 | 5.9 | 65 | 37 | 0.55 | 0.49 |
| Fabric 5 (comparative) | 92% m-aramid/5% para-aramid/3% antistatic | 6 | 25 | 4.4 | 52 | 31 | 0.59 | 0.59 |
| Fabric 6 (comparative) | 33% NOMEX ® m-aramid and KEVLAR ® p-aramid/65% modacrylic; 2% antistatic | 6.5 | 4 | 5.4 | 46.4 | 31.9 | 0.57 | 0.57 |
| Fabric 7 (comparative) | 48% modacrylic/37% Lyocell/15% p-aramid | 7 | 1 | 7.1 | 100.1 | 48.6 | 0.45 | 0.37 |
| Fabric 8 (comparative) | 88% cotton/12% nylon | 7 | 3 | 4.7 | 71.4 | 53.1 | 0.38 | 0.34 |
| Fabric 9 (comparative) | 34% NOMEX ® m-aramid and KEVLAR ® p-aramid/33% Lyocell/31% modacrylic/ 2% antistatic | 7 | 4 | 5.9 | 47.25 | 35.25 | 0.6 | 0.55 |

| | Comfort Data | Durability | | | Thermal Performance | |
|---|---|---|---|---|---|---|
| Fabric | Moisture Vapor Transmission Rate g/cm$^2$-24 h | Dry Abrasion cycles to hole | Tensile load (lbs) | Tear grams force | Arc Rating cal/cm$^2$ | Total Body Burn (3 sec) % |
| Fabric 1 | 741 | 975 | 154 × 113 | 2957 × 2406 | 10 | 34.15 |
| Fabric 2 (comparative) | 884 | 1390 | 171 × 117 | 5133 × 4403 | 5.5 | 19 |
| Fabric 3 (comparative) | 904 | 835 | 166 × 79 | 4774 × 3290 | 4.1 | 46 |
| Fabric 4 (comparative) | 714 | 640 | 109 × 68 | 4634 × 4212 | 8.9 | 26 |
| Fabric 5 (comparative) | 704 | 1500 | 162 × 149 | 6349 × 4416 | 5.6 | 35 |
| Fabric 6 (comparative) | 731 | 1140 | 139 × 104 | 5043 × 4531 | 8.4 | 37 |
| Fabric 7 (comparative) | 757 | 1030 | 139 × 93 | 4518 × 3968 | 9 | 15 |
| Fabric 8 (comparative) | 666 | 1330 | 101 × 73 | 2816 × 3072 | 8.6 | 10 |
| Fabric 9 (comparative) | 706 | 1610 | 145 × 99 | 4275 × 3392 | >8 | 14 |

Dual hazard fabrics protect against both flash fire and arc flash hazards. To achieve acceptable ratings in both categories, protective fabrics generally weigh approximately 5.5-7 oz/yd$^2$ (See Comparative Fabrics 6, 7, 8, and 9). Fiber blend and fabric weight are used simultaneously (1) to provide enough thermal insulation to limit the transfer of heat energy during arc flash and flash fire; and (2) to limit fabric break open. We have surprising found that our inventive fabric (Fabric 1) is able to achieve protection against flash fire and arc flash hazards, despite its low basis weight.

When exposed to the intense thermal stress of an electric arc, fabrics and garments comprising flame resistant fibers of low tensile strength can break open exposing the wearer to additional injury as a result of the incident energy. Electrical arcs typically involve thousands of volts and amperes of electrical current. The electrical arc is much more intense than incident energy, such as, from flash fire. To offer protection to a wearer a garment or fabric must resist the transfer of energy through to the wearer. It is believed that this occurs both by the fabric absorbing a portion of the incident energy and by the fabric resisting break open. During break open, a hole forms in the fabric directly exposing the surface or wearer to the incident energy.

High aramid blend fabrics are known to be strong and resist break open. However, the intense thermal stress of an arc flash will generally pass through (not absorb) the fabric as in Comparative Fabric 5, which weighs 6 oz/yd$^2$ but only provides 5.6 calories/cm$^2$ of protection. As weight is dropped from 6 oz/yd$^2$ to 4.5 oz/yd$^2$ (Comparative Fabric 3), the arc rating falls proportionally to 4.1 calories/cm$^2$. Consequently, lower weight, high aramid fiber blend fabrics have been limited to flash fire only applications due to the inability to absorb arc flash energy and reach an arc rating of >8 at lower fabric weights. To achieve both arc and flash fire protection, other fibers have been blended with aramids to provide better absorption of the incident energy, including modacrylics as described in U.S. Pat. No. B2-7,065,950 (See, for example, Comparative Fabric 6, as well as Comparative Fabrics 4, 7, and 9). Because a higher percentage of lower strength fibers like modacrylic and flame resistant cellulosic fibers are used, fabric basis weights can only be reduced so far. As lower strength fibers are added, break open becomes more likely effectively limiting the arc rating <8, unless a heavier weight is maintained. Comparative Fabrics 4, 6, 7, and 9 are examples of this shortcoming.

Yarns, fabrics and garments made from fiber blend of inventive Fabric 1 have a relatively high aramid content yet show an unexpected resistance to the transfer of energy under the intense thermal stress of both electric arc and flash fire at a very light weight. Heat does not pass through the fabric as in Comparative Fabrics 2, 3, and 5 and an arc rating of 10 cal/cm$^2$ is unexpectedly achieved.

As can be seen from the table, Fabric 1 (with 1% conductive antistatic fiber) exhibits a surprisingly high arc rating (10 calories/cm$^2$ making it Level 2 arc rating), especially when compared to Comparative Fabric 2 (same basis weight; similar composition) and the other commercial FR fabrics (higher basis weight). Fabric 1 also exhibits a surprisingly low total body burn from a 3 second flash fire (less than 35%), especially at such a low basis weight.

When ranges are used herein for physical properties, such as molecular weight, or chemical properties, such as chemical formulae, all combinations, and subcombinations of ranges specific embodiments therein are intended to be included.

The disclosures of each patent, patent application, and publication cited or described in this document are hereby incorporated herein by reference, in their entirety.

Those skilled in the art will appreciate that numerous changes and modifications can be made to the preferred embodiments of the invention and that such changes and modifications can be made without departing from the spirit of the invention. It is, therefore, intended that the appended claims cover all such equivalent variations as fall within the true spirit and scope of the invention.

What is claimed is:

1. A fabric, comprising:

a spun yarn comprising:

60% by weight to 80% by weight, based on the total weight of the spun yarn, meta-aramid fiber;

7% by weight to 15% by weight, based on the total weight of the spun yarn, nylon fiber;

5% by weight to 15% by weight, based on the total weight of the spun yarn, para-aramid;

less than 2% by weight, based on the total weight of the spun yarn, anti-static fiber, and 10% by weight to 15% by weight, based on the total weight of the spun yarn, fire-resistant hydrophilic fiber;

wherein said fibers are intimately blended; and wherein said fabric has a basis weight of less than 6.5 oz/yd$^2$.

2. The fabric of claim 1, wherein said fabric is a woven fabric.

3. The fabric of claim 1, wherein said fabric is a knit fabric.

4. The fabric of claim 1, wherein said fabric is a non-woven fabric.

5. The fabric of claim 1, wherein said anti-static fiber is present at a level of less than 1.5% by weight, based on the total weight of the spun yarn.

6. The fabric of claim 1, wherein said anti-static fiber is present at a level of less than 1.25% by weight, based on the total weight of the spun yarn.

7. The fabric of claim 6, wherein said woven fabric has a basis weight of less than 6.0 oz/yd$^2$.

8. The fabric of claim 1, wherein said meta-aramid fiber is present at a level of 60% by weight to 70% by weight, based on the total weight of the spun yarn.

9. The fabric of claim 1, wherein said nylon fiber is present at a level of 8% by weight to 15% by weight, based on the total weight of the spun yarn.

10. The fabric of claim 1, wherein said para-aramid fiber is present at a level of 8% by weight to 15% by weight, based on the total weight of the spun yarn.

11. The fabric of claim 1, wherein said fire-resistant hydrophilic fiber is present at a level of 12% by weight to 15% by weight, based on the total weight of the spun yarn.

12. The fabric of claim 1, wherein said fire-resistant hydrophilic fiber is present at a level of 10% by weight to 13% by weight, based on the total weight of the spun yarn.

13. The fabric of claim 1, wherein said fire-resistant hydrophilic fiber is selected from the group consisting of cellulosic fiber, wool fiber, silk fiber, fire resistant acrylic derivative fiber, and combinations thereof.

14. The fabric of claim 1, wherein said spun yarn comprises:

85% by weight to 90% by weight, based on the total weight of the spun yarn, hydrophobic component; and 10% by weight to 15% by weight, based on the total weight of the spun yarn, hydrophilic component.

15. The fabric of claim 1, wherein said anti-static fiber comprises a conductive fiber.

16. The fabric of claim 1, wherein said anti-static fiber comprises a carbon fiber with a nylon sheath.

17. The fabric of claim 1,
wherein said spun yarn further comprises an elastomeric filament.

18. An article, comprising:
the fabric of claim 1.

19. A woven fabric, comprising:
a spun yarn comprising:
66% by weight, based on the total weight of the spun yarn, meta-aramid fiber;
9% by weight, based on the total weight of the spun yarn, nylon fiber;
12% by weight, based on the total weight of the spun yarn, para-aramid;
1% by weight, based on the total weight of the spun yarn, anti-static fiber; and
12% by weight, based on the total weight of the spun yarn, FR rayon;
wherein said fibers are intimately blended; and
wherein said woven fabric has a basis weight of less than 6.5 oz/yd$^2$.

20. An article, comprising:
the fabric of claim 19.

* * * * *